US006308763B1

(12) United States Patent
Moeckl

(10) Patent No.: US 6,308,763 B1
(45) Date of Patent: Oct. 30, 2001

(54) MOBILE DIVIDING WALL

(75) Inventor: Ernst Moeckl, Stuttgart (DE)

(73) Assignee: Preform Raumgliederungssysteme GmbH, Feuchtwangen (DE)

( * ) Notice: Subject to any disclaimer, the term of this patent is extended or adjusted under 35 U.S.C. 154(b) by 0 days.

(21) Appl. No.: 09/029,270

(22) PCT Filed: Jul. 2, 1997

(86) PCT No.: PCT/EP97/03447

§ 371 Date: Mar. 2, 1998

§ 102(e) Date: Mar. 2, 1998

(87) PCT Pub. No.: WO98/00613

PCT Pub. Date: Jan. 8, 1998

(30) Foreign Application Priority Data

Jul. 2, 1996 (DE) ..... 196 26 521

(51) Int. Cl.[7] ..... A47G 5/00
(52) U.S. Cl. ..... 160/135; 160/229.1
(58) Field of Search ..... 160/135, 351, 160/229.1; 52/239, 238.1

(56) References Cited

U.S. PATENT DOCUMENTS

| | | | | |
|---|---|---|---|---|
| 3,571,999 | * | 3/1971 | Downing | 160/135 X |
| 4,047,337 | * | 9/1977 | Bergstrom | 160/135 X |
| 4,090,335 | * | 5/1978 | Curatolo | 52/239 |
| 4,493,174 | * | 1/1985 | Arens | 52/243 |
| 4,606,394 | * | 8/1986 | Bannister | 160/135 X |
| 4,635,418 | * | 1/1987 | Hobgood | 160/135 X |
| 5,007,473 | * | 4/1991 | Evensen | 160/135 |

* cited by examiner

*Primary Examiner*—David M. Purol
(74) *Attorney, Agent, or Firm*—Helfgott & Karas, P.C.

(57) ABSTRACT

A mobile dividing wall comprises at least two wall members which, for the purposes of mutually joining their border sides in a variable-angle manner, have at least partly complementary convex border profiles coated with burred material. The wall members also have complementary positioning members which mutually engage, at least when the wall members are at a specific angle to one another, in that a projection of the one positioning member enters an indentation of the other positioning member. Alternatively, the wall members have complementary positioning members which mutually exert a magnetic force of attraction, at least when the wall members are at a specific angle to one another.

12 Claims, 8 Drawing Sheets

MOBILE DIVIDING WALL

FIELD OF THE INVENTION

The present invention concerns a mobile dividing wall comprising at least two wall elements which, for their variable angular joining with one another on the contact sides, have convex edge profiles which at least in sections are co-ordinated with each other and covered with VELCRO-like material.

A registered trade-mark of Velcro Industries B.V. for a burr-like fastening tape.

BACKGROUND OF THE INVENTION

Such a mobile dividing wall is, for example, known from the French Patent Application 2,570,408. Also the Unexamined German Patent Application 4,207,644 discloses such a mobile dividing wall to be used in particular for the subdivision of large rooms.

Known mobile dividing walls of the generic type can be installed quickly, because when two wall elements are assembled, there is, between the VELCRO-like material of the two wall elements, a durable connection which eliminates a displacement with regard to one another of the two joined wall elements. The VELCRO-like material in connection with the convex edge profiles allows, by rolling off the edge profiles on one another, a smooth change of the angular position of the two wall elements relative to each other without the wall elements having to be separated from one another. This possibility of particularly quick installation with at the same time great flexibility with regard to the arrangement is also the reason for the widespread distribution of generic dividing walls. The quick and firm adherence of the VELCRO-like material of the edge profiles facing each other of two wall elements to be joined together also has a significant disadvantage because a later adjustment of the position of the wall elements relative to one another to correct a misalignment in height, side or angle is not possible due to the strong adhesion of the VELCRO-like material in the case of joined wall elements. The installation of a dividing wall of wall elements aligned exactly to one another requires several attempts to join two wall elements which is time consuming and troublesome. Thus, in practice, it happens that with installed mobile dividing walls of the type mentioned herein, the individual wall elements show a slight misalignment (height, parallelism, lateral misalignment) with one another which, to eliminate, would require reinstallation of the dividing wall.

Therefore, the object of the present invention is to provide a mobile dividing wall which can be installed quickly and without any problem and in the case of which the individual wall elements are adjusted to each other largely without unwanted misalignment.

SUMMARY OF THE INVENTION

According to the present invention, the wall elements have positioning elements coordinated to one another which at least in a certain angular position of the wall elements interlock with each other by a protrusion of the one positioning element entering a recess of the other positioning element. The protrusion of the one and the recess of the other positioning element are dimensioned in such a way that when the wall elements are assembled, the respective protrusion enters the recess before the coordinated VELCRO-like materials of the two wall elements come into contact. By means of positioning elements provided on the wall elements to be connected with each other, it is thus ensured that a connection is only established between the coordinated, VELCRO-like materials when the two wall elements are aligned with one another in the way determined by the positioning elements. The invention results in a position of the wall elements to be joined with one another which shows no undesired misalignment. A subsequent swiveling of the wall elements relative to one another, rolling off the edge profiles on each other, is certainly not obstructed here by the positioning elements.

Depending on the requirements of the respective mobile dividing wall, the invention can be realized in a variety of different embodiments. A first preferred further embodiment of the dividing wall according to the invention is characterized in that for the vertical alignment of the two wall elements relative to one another, the protrusion of the one positioning element is designed as a rib extending in a horizontal plane. The recess of the other positioning element forms a groove extending in a horizontal plane. This ensures an exact vertical positioning of the two wall elements to be connected with one another. For this purpose, one single positioning element per wall element is sufficient. If two such positioning elements are provided per wall element, preferably in the area of the upper and the lower edge, it also ensures that the axes of the two wall elements are parallel when the ribs and grooves are appropriately dimensioned. On the other hand, such an embodiment of the positioning elements allows a lateral misalignment of the wall elements with respect to one another. In cases where a lateral offset of the wall elements to be joined together is desired or even required, this embodiment of the invention is therefore suitably used. The rib and the corresponding groove extend each in the direction of the periphery over a considerable area of the corresponding positioning element which becomes clear from the other embodiments.

The vertical positioning and securing of the wall elements to be connected together not only works out advantageously in the first-time joining of two wall elements. It prevents, moreover, the (vertical) "traveling" of two joined together wall elements with regard to one another, which occasionally can be observed in the case of conventional, generic mobile dividing walls with repeated changes of the angular position of the wall elements with respect to one another. With such a mobile dividing wall designed according to the invention, any frequent change of the angular position of the wall elements with respect to one another, rolling off the convex edge profiles coated with VELCRO-like material on each other, does not result in a vertical misalignment of the wall elements relative to one another.

If a connection of the wall elements free of vertical misalignment is required in addition to the vertical alignment/securing of position, the positioning elements also suitably have additional pins and recesses corresponding to each other in which case at least one angular position of the wall elements relative to one another, one pin each of the one positioning element engages each recess of the other positioning element. This ensures an arrangement of the connected wall elements with regard to one another which is absolutely without misalignment in every respect.

The same effect is obtained when a series of spikes are provided on the one positioning element while the other positioning element has a series of holes in which case the pins and the holes interlock.

Within the scope of the present invention, the above elucidated vertical positioning of the wall elements with respect to one another (in particular by means of the interlocking ribs and grooves described above) can be dropped if required and a positioning with regard to parallel axes can be provided without lateral misalignment. Thus, a feature of another preferred embodiment of the mobile dividing wall according to the invention is that the two positioning elements have toothed rims corresponding to one another, of which the teeth mesh. The depth of the teeth of the two toothed rims is here determined in such a way that the teeth mesh before the two VELCRO-like materials come into contact with one another. This ensures an axially parallel alignment of the two joined together wall elements.

For the positioning of the two wall elements relative to one another which is axially parallel and free of lateral misalignment, a further embodiment of the invention is suitable in which the protrusion of the one positioning element is designed as pin and the hole in the other positioning element as a recess so that in certain angular positions of the wall elements relative to one another, the pin of the one positioning element enters the recess of the other positioning element. With appropriate dimensioning of the pins and recesses with respect to one another, this further embodiment of the invention is suited to ensure an additional vertical positioning/adjustment of the wall elements relative to one another.

According to a solution of the stated problem, it is provided that the wall elements have positioning elements coordinated with one another which at least in a certain angular position of the wall elements with respect to one another have a magnetic attraction on one another, bringing about the alignment of the wall elements during the installation. With the positioning elements of two wall elements opposing each other, two magnets can be opposite one another in such a way that with walls ideally aligned to one another, the south pole of the magnet of the one positioning element is opposite the north pole of a magnet of the other positioning element. Compared with the embodiment of the invention elucidated above, it is considered as an advantage that the positioning elements are not noticeable on the outside. This not only has aesthetic aspects, this arrangement also allows conventional wall elements and those according to the conceptual solution elucidated above to be joined together. That means in practice that a user can build on his previous supply of wall elements and supplement these without problem by those according to the invention. This further development of the invention with magnetic positioning elements is also suited for joining together wall elements of different height; each edge profile then can be provided with several magnetic positioning elements installed at various heights.

In some of the embodiments of the invention elucidated above, the positioning elements cannot be used to ensure the exact alignment of the two wall elements to be joined together. Another, very helpful, additional possible function of the positioning elements is elucidated in the following: With conventionally installed, generic mobile dividing walls, the separation into the individual wall elements is difficult upon dismantling; the VELCRO-like materials adhere so firmly to each other in every angular position of the two wall elements that a separation of the wall elements is only possible with a lot of effort and/or with the aid of supplementary means. In order to find a remedy here, the positioning elements provided according to the present invention can be designed in such a way that when the two wall elements are swung towards each other, these elements spread apart the two edge profiles, that is, increase the distance of the central axes of the two edge profiles and separate in this way the VELCRO-like materials from one another. Thus, by means of a suitable design of the protrusions and/or holes provided on the positioning elements and/or by integration of separate protrusions, it is possible for the two edge profiles to be gradually pushed from each other. This can be realized, for example, where a horizontal groove and a horizontal rib interact, the rib extends over about 180°, the groove, on the other hand, only has its full depth over an area of in total 120°, that is the depth for which the rib can be fully accommodated. Outside this area, the depth of the groove gradually decreases so that the rib, with increasing reduction of the angle between the two wall elements, comes out of the groove and separates the two edge profiles covered with VELCRO-like material from each other. A corresponding embodiment of the edge profiles with a comparable effect is also possible, without this having to be elucidated in detail, in various other ones of the further embodiments of the invention elucidated above, for example, when the two positioning elements coordinated with one another have pins and holes, toothed rims or the like. Further down, protrusions are also elucidated which are provided on the positioning elements and serve exclusively the purpose of pushing these from each other and in this way opening up the VELCRO-like connection.

The invention is not limited to such dividing walls for which wall elements of the same height are assembled. Rather, within the scope of the invention, wall elements of different height also can be joined together to a dividing wall. This occurs when the positioning elements, coordinated with one another, irrespective of their height, are all arranged at the same level. Of course, also in the case of wall elements of different height, the positioning elements can in principle be provided in the area of the respective upper and lower corners. In this case, care has only to be taken that the protrusions of the positioning elements of the lower wall element, which the coordinated edge profile of a higher wall element faces, can be moved or pushed, against a spring, into the inside of the edge profile in such a way that they do not hinder the joining of the two wall elements. In this sense, a feature of a preferred further embodiment of the invention is that the protrusions of the positioning elements enter, against a spring, into the latter.

Likewise, with respect to the possibility of connecting wall elements of different height with one another, a feature of another preferred embodiment of the invention is that the positioning elements are constructed of two parts as they comprise a base part and an attachment which can be connected to it. The base part is in this case firmly connected to the corresponding wall element. And the attachment can—as required—be put on or removed from it. Suitably in this case, a click-stop connection to be actuated completely without tool, or at least simply with only little effort, is provided between the base part and the attachment.

The separating aid described above also can be integrated in the form of appropriate protrusions in such two-part positioning elements. In this case, the appropriate projections bringing about the separation are suitably provided on the base part so that, irrespective of whether an attachment is put on this or not, an easy separation of two wall elements connected with one another is made possible.

Another preferred further embodiment of the invention is characterized in that the positioning elements can be moved slidingly along the respective edge profile. This is applicable for such positioning elements which may well comprise no recess but one or several protrusions whether in the form of an individual pin, in the form of a series of spikes, in the form of a horizontally extending rib or the like. In the case of such further developed wall elements, the positioning element of the higher wall element can be lowered to the level of the in each case lower wall element.

Only for the sake of completeness, it should be pointed out that the wall elements by no means necessarily have to be rectangular. On the contrary, wall elements with inclined and/or curved upper edges can of course also be considered to be within the scope of the invention. Further advantages as well as other preferred further developments of the present invention follow from the exemplified embodiments described in connection with the drawing as well as the subordinate claims.

BRIEF DESCRIPTION OF THE DRAWINGS

In the following, the invention is elucidated in detail by means of the exemplified embodiments represented in the drawing.

DETAILED DESCRIPTION OF THE INVENTION

Figure 1:
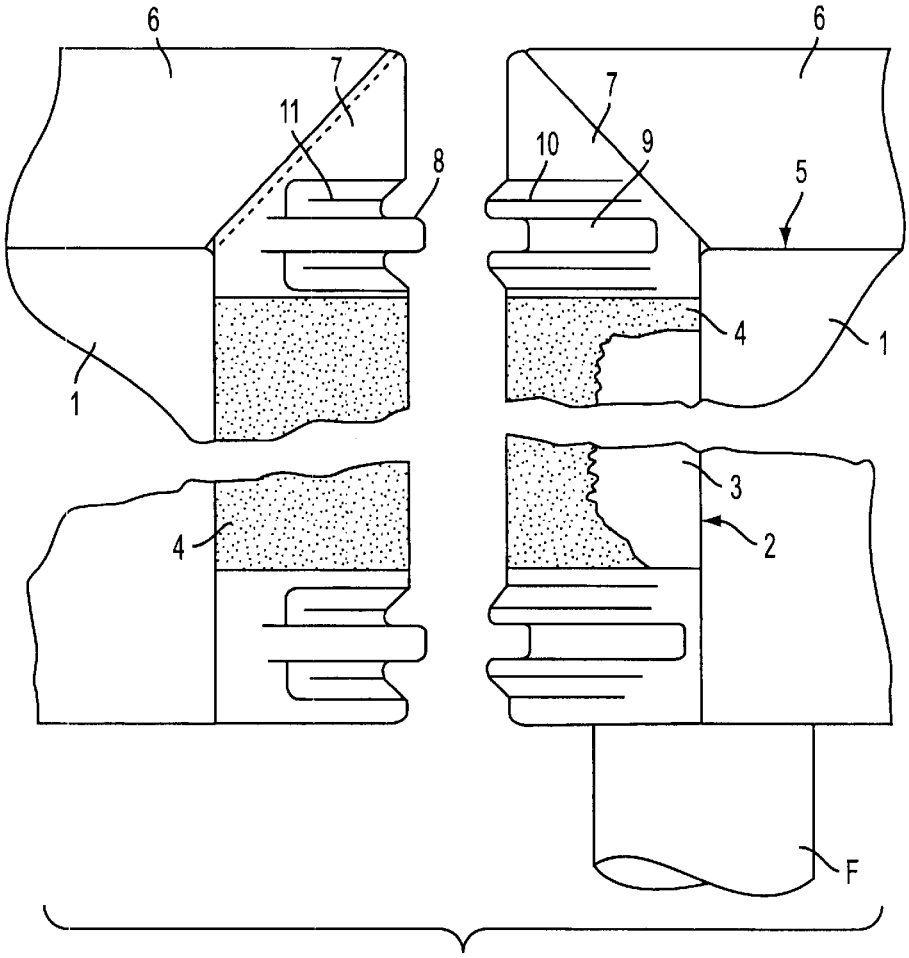
FIG. 1 shows a side view of a first preferred embodiment of two to-be-joined together wall elements of a mobile dividing wall.

The wall elements, represented in the drawing, comprise each a rectangular wall body 1, on the vertical ends 2 of which edge profiles 3 with a cylindrical, convex surface are mounted. The edge profiles 3 are covered almost over their entire height with a hook and loop or VELCRO-like material 4. Moreover, on each wall body always along the upper horizontal end 5, a covering profile 6 is mounted. In the area of the lower horizontal ends of the wall body 1, support legs F are provided.

Positioning elements 7 are always provided at each corner of each wall element in the area of the upper and of the lower end of the edge profiles 3. These are in each case connected in a suitable manner (clamps, screws, adhesives or the like) with the adjacent edge profile 3, if required to the covering profile 6 and/or the wall body 1. In the various embodiments of the invention, represented in the drawing, essentially only the positioning elements differ from one another. Therefore, in the following only the respective pair of interacting positioning elements is treated.

According to FIG. 1, one of the positioning elements has a rib 8 which extends in a horizontal plane over an angular range of almost 180°. The corresponding positioning element is provided with a groove 9 which likewise extends in a horizontal plane over almost 180°. The width of the groove is here only slightly greater than the thickness of the rib 8. The groove 9 is in this case limited by two collars 10 which protrude only slightly above the surface of the edge profile. Correspondingly, the edge profile which has the rib 8 is provided, next to the rib, with depressions 11 in which the collars 10 can interlock. When the two wall elements are assembled, before the VELCRO-like material 4 of the two edge profiles 3 enter into contact with one another, the rib 8 always interlocks with the groove 9 both in the case of the upper and the lower pair of positioning elements whereby a vertical positioning as well as an axially parallel alignment of the two wall elements with respect to one another are ensured. However, a lateral misalignment of the two wall elements relative to one another is possible. Each individual pair of positioning elements ensures in this case a vertical adjustment in both directions already immediately after the rib 8 enters the groove 9. In this respect, there is a difference with the embodiment according to FIG. 3 elucidated below.

Figure 2:
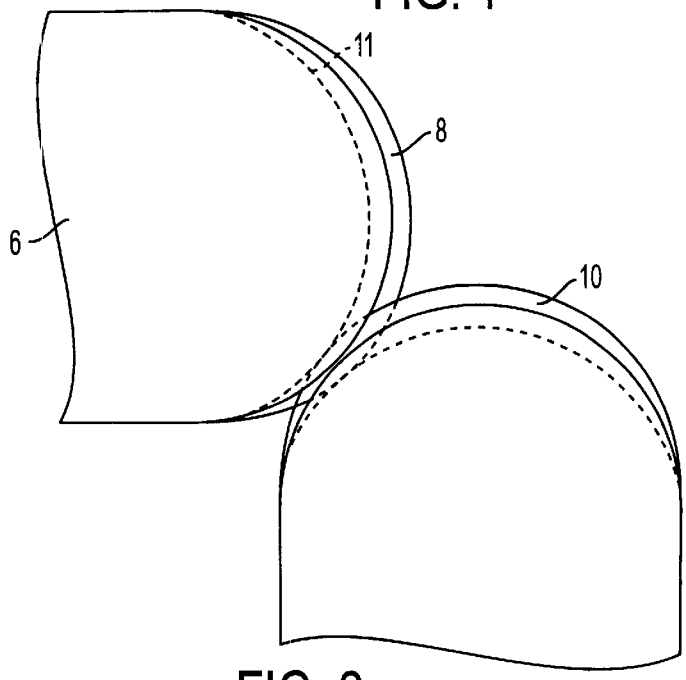
FIG. 2 shows a top view of the two wall elements according to FIG. 1, according to which they were joined together at right angles.
Figure 3:
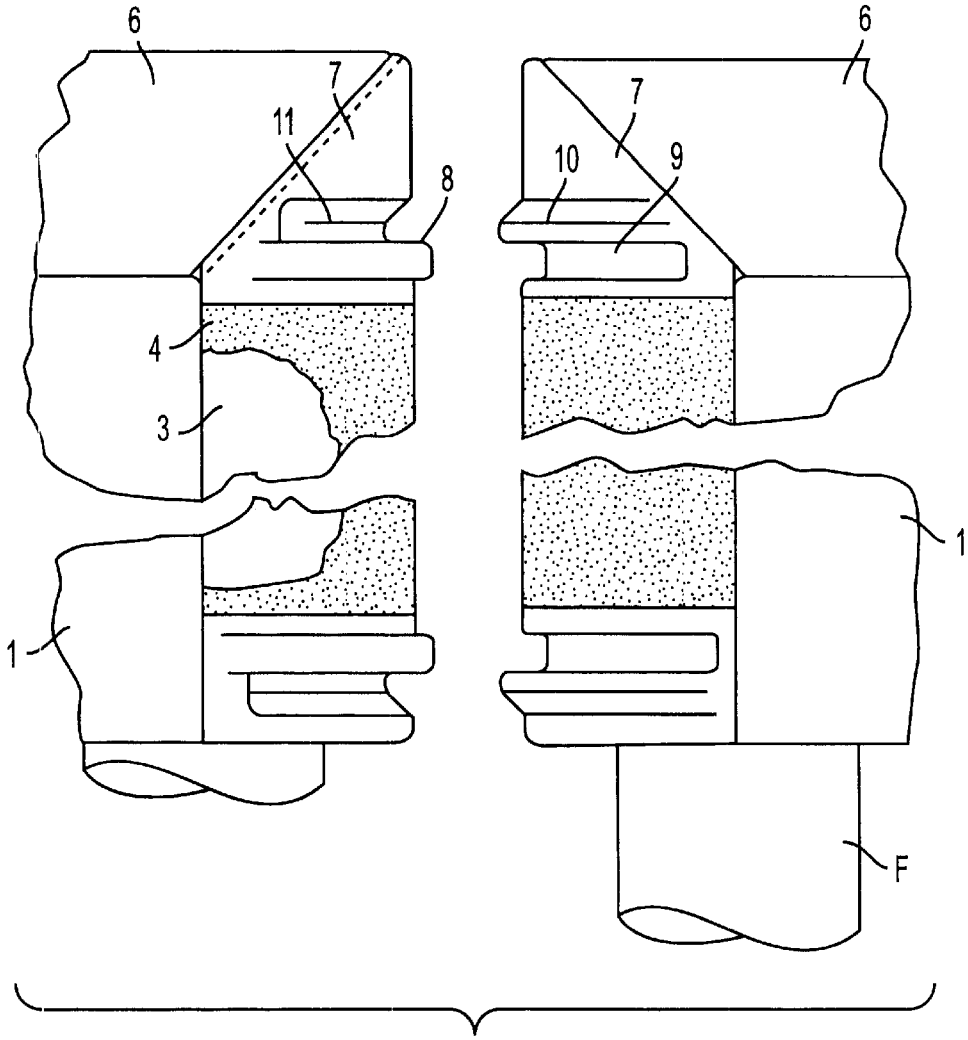
FIG. 3 shows a side view of a second preferred embodiment of two to-be-joined together wall elements of a mobile dividing wall.

The embodiment of the positioning elements represented in FIG. 3 of the drawing differs essentially only from FIG. 1 and FIG. 2 in that next to the rib 8 only one depression 11 is provided and next to the groove 9 only one collar 10 corresponding to the depression 11. Each of the positioning elements provided in the area of the lower edge of the wall body 1 are installed mirror-symmetrically to the upper ones. The upper and the lower positioning interact together in such a way that when the two wall elements are assembled, their exact vertical positioning with respect to one another is ensured because one pair of positioning elements takes on the vertical adjustment in the one direction, the other pair of positioning elements the adjustment in the other direction. In this way there is a simplification of the installation. Also the embodiment of the positioning elements according to FIG. 3 makes possible a lateral misalignment between the wall elements while still permitting connection with one another.

Figure 4:
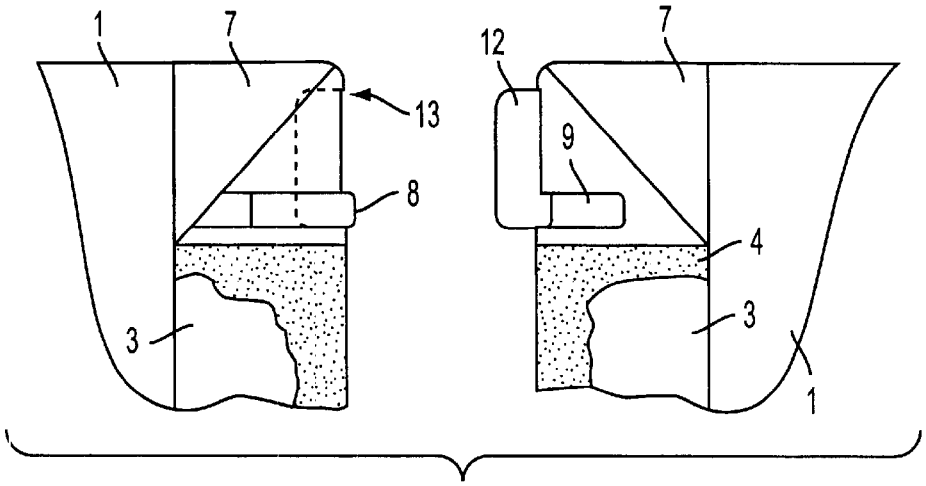
FIG. 4 shows a side view of a third preferred embodiment of two wall elements of a mobile dividing wall.
Figure 5:
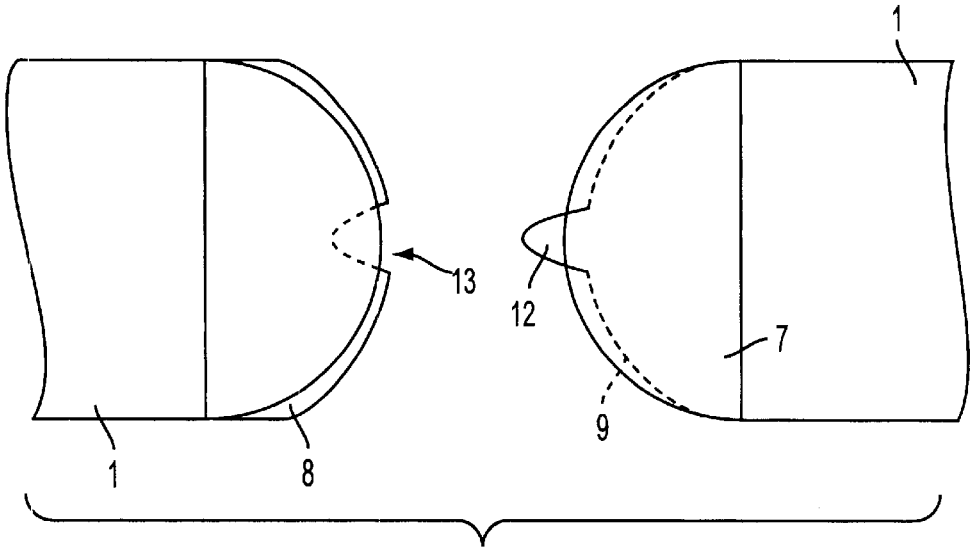
FIG. 5 shows a top view of the wall elements according to FIG. 4.

The positioning elements shown in FIGS. 4 and 5 also are provided with a rib 8 extending over an angular range of almost 180° and a corresponding groove 9 with which the rib interlocks when the wall elements are assembled to ensure a vertical adjustment of the wall elements. The groove 9 extends in this case, as is also possible in other embodiments, only over a clearly smaller angular range then the rib 8. This facilitates the disassembly of the mobile dividing wall when the two wall elements are swung together until they touch each other. At the end of the groove 9, the rib 8 runs onto the external face of the positioning element 7 whereby the two edge profiles are pushed away from each other and the two VELCRO-like materials 4 lose contact. The equivalent can, of course, also be realized in the case of the other embodiments of the positioning elements.

The pair of positioning elements represented in FIGS. 4 and 5 differ moreover from the previously elucidated embodiments in that one of the positioning elements is in addition provided with a nose 12 whereas the other is provided in addition with a recess 13. The nose 12 protrudes in this case over the remaining contour of the pertinent positioning element. The recess 13 forms a corresponding depression in the contour of the other positioning element. Nose 12 and recess 13 of the two positioning elements ensure that the two wall elements can be joined together without lateral misalignment. They do not, however, hinder a change in angle of the wall elements relative to one another with the edge profiles 3, covered with VELCRO-like material 4, rolling off on each other.

From FIG. 4 it can be seen that the nose 12 and the recess 13, however, do not only serve to ensure an arrangement of the wall elements with respect to each other which is axially parallel and free from lateral misalignment. They ensure moreover, within the angular range in which the nose interlocks with the recess, a vertical adjustment of the two wall elements with respect to each other. Accordingly, the rib 8 and the groove 9 are of a flat design as is the case in the earlier described embodiments of the positioning elements. Thus, they only serve to prevent a displacement of the already assembled wall elements when the angular position is changed.

Figure 6:
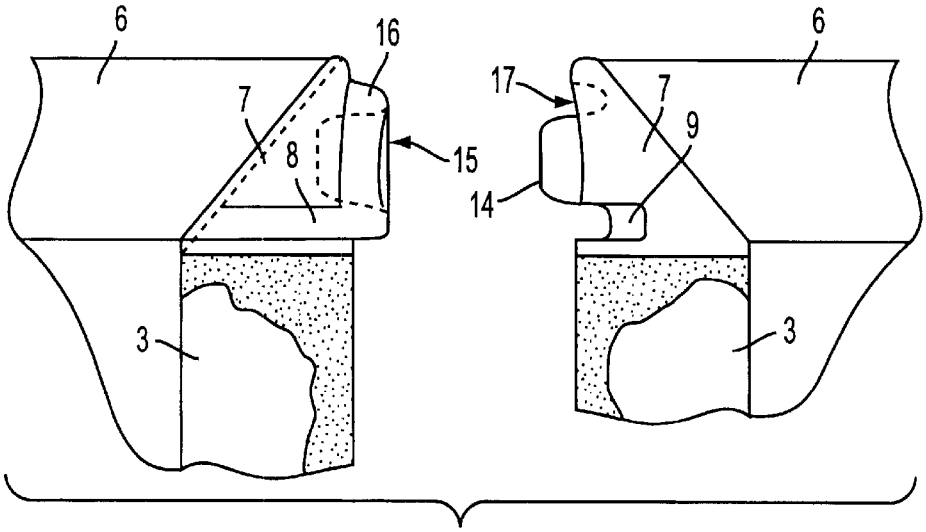
FIG. 6 shows a side view of a fourth preferred embodiment of two wall elements of a mobile dividing wall.
Figure 7:
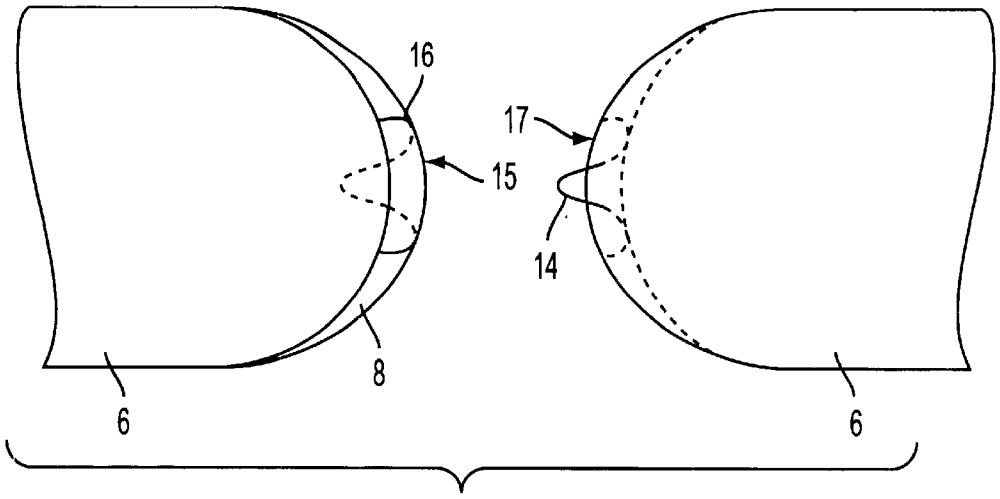
FIG. 7 shows a top view of the wall elements according to FIG. 6.

Also the pair of positioning elements represented in FIGS. 6 and 7 is provided with a combination of positioning means. In the first place, one of the positioning elements has a rib 8 extending in a horizontal plane over a peripheral range and the other positioning element has a corresponding groove 9. Supplementary to this, one positioning element is provided with a flat-oval pin 14 and the other positioning element with a thereto corresponding recess 15. The recess is surrounded by a ring-shaped collar 16. The latter interlocks with a depression surrounding the pin 14 when the two wall elements are assembled and aligned with one another. Through the combination of, on the one hand, pin 14 and depression 17, and, on the other hand, recess 15 and collar 16, early pre-positioning is achieved in the assembly of the wall elements. This simplifies the assembly of the dividing wall. If the two joined together wall elements are swung out of their position, the pairing of rib 8 and groove 9 assume a vertical position and prevent a "traveling" of the two wall elements with respect to one another.

Figure 8:
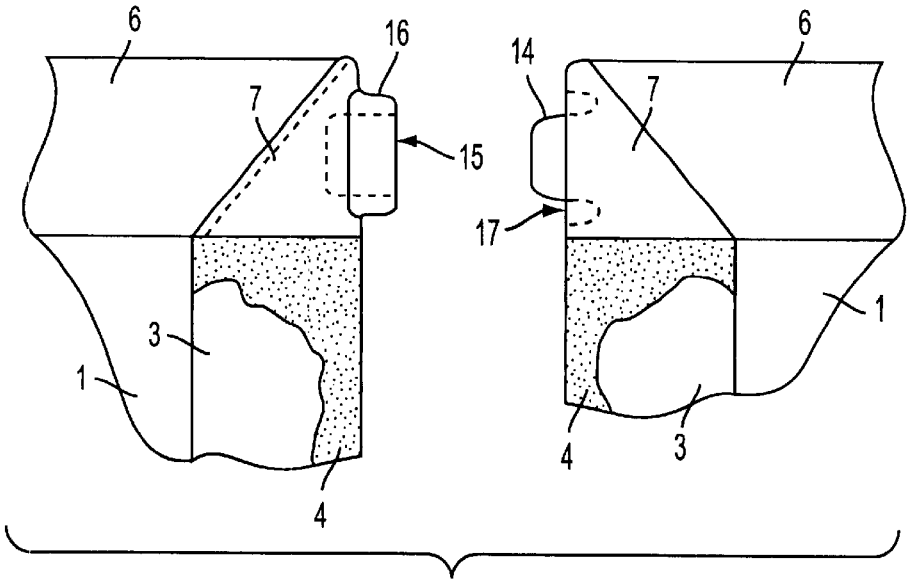
FIG. 8 shows a side view of a fifth preferred embodiment of two wall elements of a mobile dividing wall.

In comparison with the previously described embodiment, a rib extending in the peripheral direction and a thereto corresponding groove were dispensed with in the case of the pair of positioning elements represented in FIG. 8. This embodiment corresponds essentially to the one previously described. The only difference is that the pin 14 is made somewhat wider. In this way, it interlocks with the corresponding recess 15 over a wider swinging range of the wall elements relative to one another so that the vertical position is ensured over a wider angular range by means of the interlocking of pin 14 and recess 15.

Figure 9:
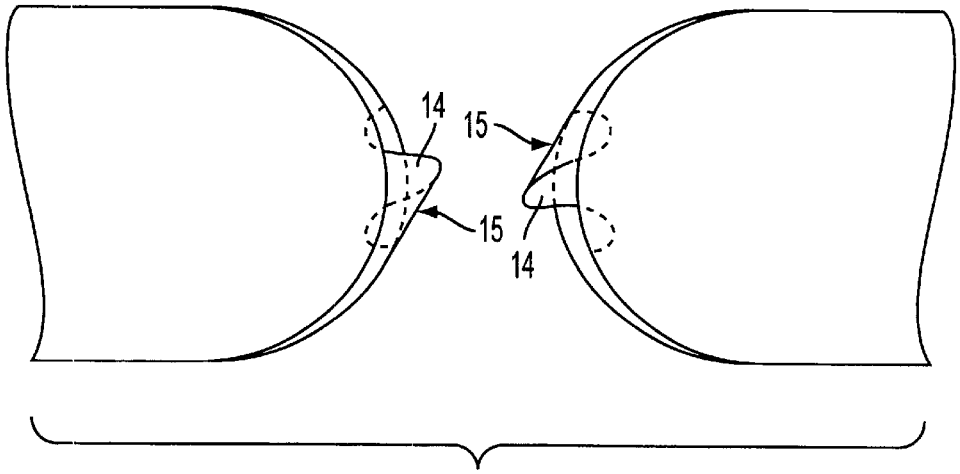
FIG. 9 shows a top view of a sixth preferred embodiment of two wall elements of a mobile dividing wall.

The distinctive feature of the pair of positioning elements represented in FIG. 9 is that the latter are of identical design. Each positioning element is in itself asymmetrical. It is essentially provided with a pin 14 and an adjacent recess 15. The identical design of both positioning elements of a pair is suited to reduce manufacturing and storage costs which is an advantage compared to all previously describe embodiments.

Figure 10:
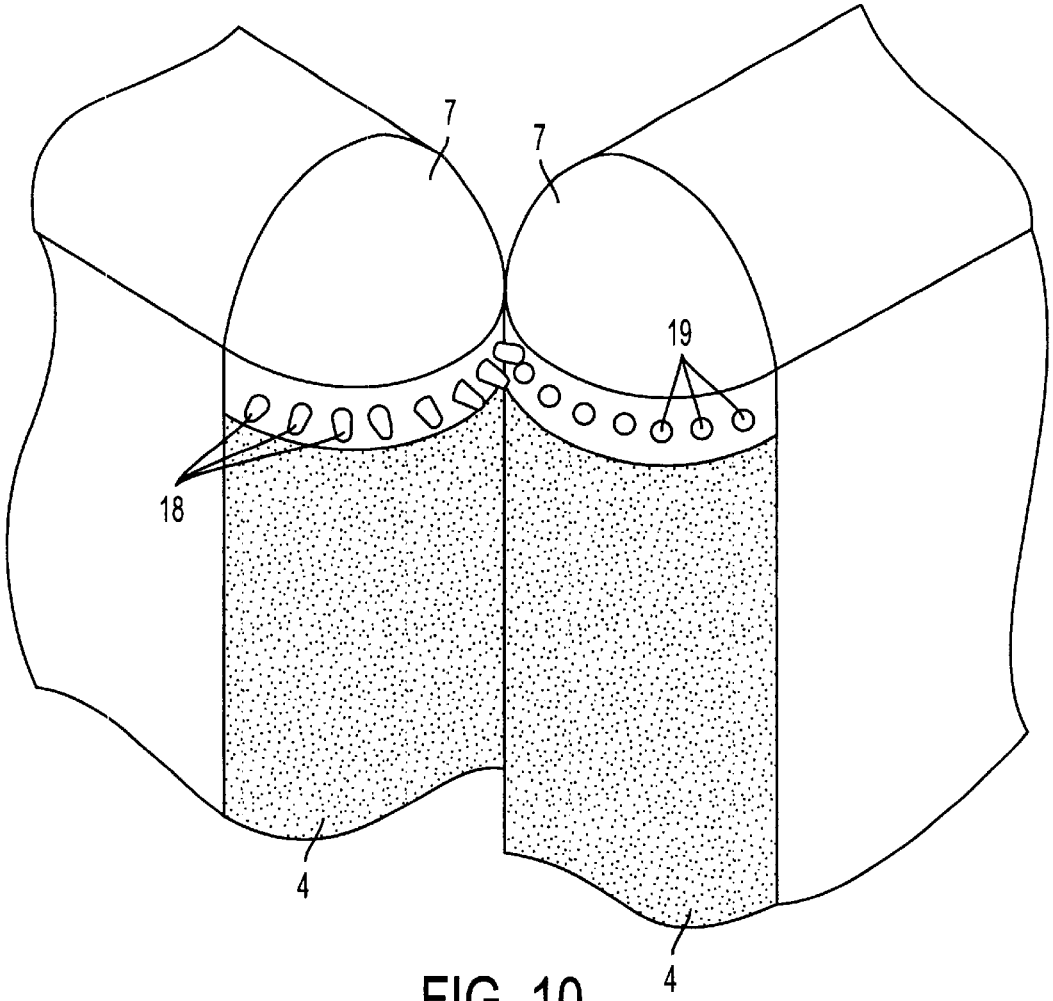
FIG. 10 shows a perspective view of a seventh preferred embodiment of the invention.

FIG. 10 illustrates the embodiment of the two positioning elements 7 in such a way that one of them has a wreathlike series of spikes 18, whereas the other positioning element has a series of holes 19. Over the entire swinging range of the two wall elements with respect to one another, at least one spike 18 interlocks with a coordinated hole 19. In this way, an exact alignment of the two wall elements with one another is achieved without misalignment in height, without lateral misalignment and also without tilting of the two edge profiles with respect to one another. The two outer holes 19 are less deep than the coordinated spikes 18 are long. In this way, when the two wall elements are swung together until they touch one another, the edge profiles are pushed from one another whereby the two VELCRO-like materials 4 are separated.

Figure 11:
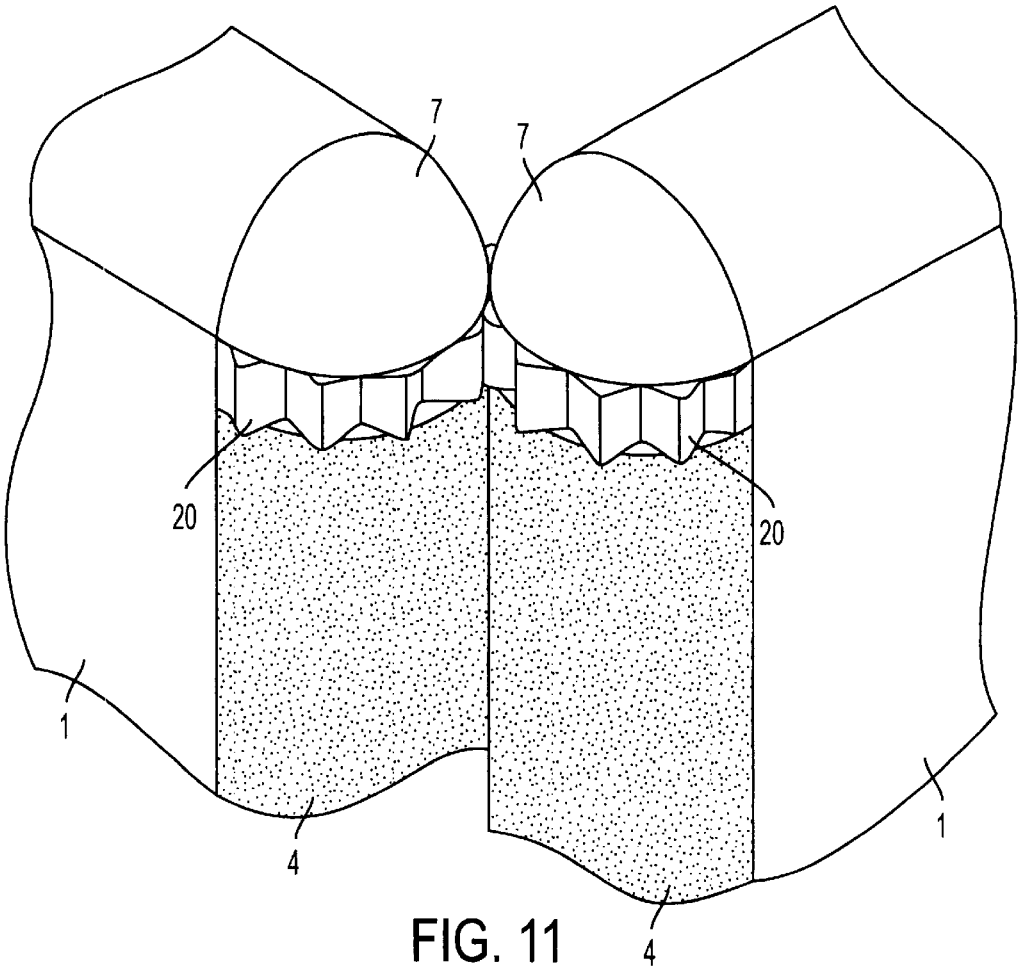
FIG. 11 shows a perspective view of an eighth preferred embodiment of the invention.

FIG. 11 illustrates an embodiment of the two positioning elements 7 in such a way that they have toothed rims 20 with teeth corresponding and interlocking with one another. This results in an axially parallel alignment of the two wall elements with one another. Moreover, an adjustment with regard to height takes place as in each case a tooth of the one toothed rim interlocks with a tooth gap of the other toothed rim which is limited downwards by the edge profile covered with VELCRO-like strip 4. However, this embodiment of the positioning devices allows a lateral misalignment of the two wall elements with respect to one another.

Figure 12:
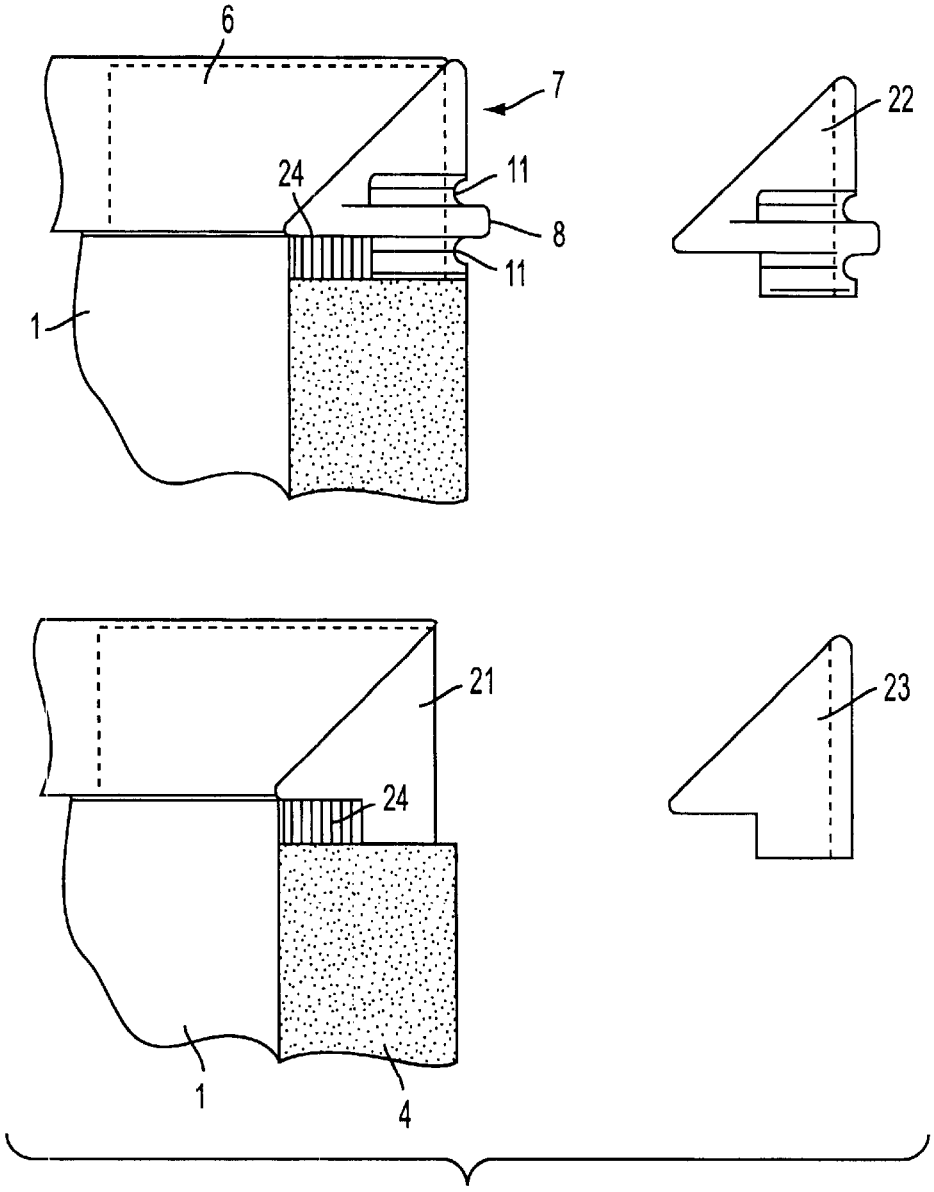
FIG. 12 shows a side view of a ninth preferred embodiment of the invention.

FIG. 12 illustrates that the positioning element utilized within the scope of the invention also can be designed in two parts, in that it consists of a base part 21 and an attachment 22. The attachment 22 can—depending on requirement—be installed on the base part 21 or removed from the latter. The base part 21 is in this case connected firmly to the wall element. But a snap connection, detachable without tool, is used for the fastening of the attachment 22 to the base part 21.

On the attachment 22, as was elucidated in detail in connection with FIG. 1, a rib 8 and two depressions 11 are provided so that the positioning element 7, made up of base part 21 and attachment 22, acts in the same way as that shown in connection with FIG. 1.

FIG. 12 further illustrates that alternatively to the attachment 22, a cover 23 can also be mounted on the base part 21. This makes the visual appearance of the corner area of the free edge of a wall element, not connected with another wall element, as inconspicuous as possible. Moreover, it can be seen from FIG. 13 that on the base part 21, projections 24 can be provided which in each case protrude over the edge profile covered in VELCRO-like material. If two wall elements connected with one another are swung towards each other until they touch, reducing the angle formed between them and rolling off the edge profiles on each other, the projections 24 of the opposing base parts 21 of the positioning elements 7 meet and bring about the separation of the VELCRO-like material 4 in the manner already described above.

What is claimed is:

1. A mobile dividing wall comprising:

at least two wall elements which have convex edge profiles which at least in sections are aligned with each other and covered with hook and loop fabric material, said wall elements having a plurality of positioning elements that are engageable with one another over a defined range of angular positions and which are capable of interlocking when each of said wall elements are arranged in a particular angular position of said range with respect to the other, said positioning elements further comprising a protrusion of a first positioning element on one wall element entering a recess of a second positioning element on the other wall element, said protrusion and said recess of said positioning elements extending outwardly from said one wall element with respect to said hook and loop fabric material such that when the wall elements are assembled, the respective protrusion enters the recess before the hook and loop fabric materials of the wall elements come into contact, wherein said protrusion is a rib extending in a horizontal plane and said recess is a groove extending in a horizontal plane, wherein said first positioning element further comprises a pin and said second positioning element comprises a recess.

2. A mobile dividing wall according to claim 1, wherein said recess further comprises a hole.

3. A mobile dividing wall according to claim 1, wherein said recess is enclosed by a surrounding collar and said pin is enclosed by a surrounding depression.

4. A mobile dividing wall comprising:

at least two wall elements which have convex edge profiles which at least in sections are aligned with each other and covered with hook and loop fabric material, said wall elements having a plurality of positioning elements that are engageable with one another over a defined range of angular positions and which are capable of interlocking when each of said wall elements are arranged in a particular angular position of said range with respect to the other, said positioning elements further comprising a protrusion of a first positioning element on one wall element entering a recess of a second positioning element on the other wall element, said protrusion and said recess of said positioning elements extending outwardly from said one wall element with respect to said hook and loop fabric material such that when the wall elements are assembled, the respective protrusion enters the recess before the hook and loop fabric materials of the wall elements come into contact, wherein said protrusion is a rib extending in a horizontal plane and said recess is a groove extending in a horizontal plane, and further comprising a depression provided adjacent to said rib and a collar provided adjacent to said groove.

5. A mobile dividing wall according to claim 4, further comprising two depressions provided adjacent to said rib and two collars provided adjacent to said groove.

6. A mobile dividing wall comprising:

at least two wall elements which have convex edge profiles which at least in sections are aligned with each other and covered with hook and loop fabric material, said wall elements having a plurality of positioning elements that are engageable with one another over a defined range of angular positions and which are capable of interlocking when each of said wall elements are arranged in a particular angular position of said range with respect to the other, said positioning elements further comprising a protrusion of a first positioning element on one wall element entering a recess of a second positioning element on the other wall element, said protrusion and said recess of said positioning elements extending outwardly from said one wall element with respect to said hook and loop fabric material such that when the wall elements are assembled, the respective protrusion enters the recess before the hook and loop fabric materials of the wall elements come into contact, wherein said first positioning elements further comprise a series of spikes and said second positioning elements further comprise a series of holes, said spikes and holes being adapted to mesh with each other to form an interlock.

7. A mobile dividing wall comprising:

at least two wall elements which have convex edge profiles which at least in sections are aligned with each other and covered with hook and loop fabric material, said wall elements having a plurality of positioning elements that are engageable with one another over a defined range of angular positions and which are capable of interlocking when each of said wall elements are arranged in a particular angular position of said range with respect to the other, said positioning elements further comprising a protrusion of a first positioning element on one wall element entering a recess of a second positioning element on the other wall element, said protrusion and said recess of said positioning elements extending outwardly from said one wall element with respect to said hook and loop fabric material such that when the wall elements are assembled, the respective protrusion enters the recess before the hook and loop fabric materials of the wall elements come into contact, wherein protrusions of the positioning elements are spring-biased into the recesses of said positioning elements.

8. A mobile dividing wall comprising:

at least two wall elements which have convex edge profiles which at least in sections are aligned with each other and covered with hook and loop fabric material, said wall elements having a plurality of positioning elements that are engageable with one another over a defined range of angular positions and which are capable of interlocking when each of said wall elements are arranged in a particular angular position of said range with respect to the other, said positioning elements further comprising a protrusion of a first positioning element on one wall element entering a recess of a second positioning element on the other wall element, said protrusion and said recess of said positioning elements extending outwardly from said one wall element with respect to said hook and loop fabric material such that when the wall elements are assembled, the respective protrusion enters the recess before the hook and loop fabric materials of the wall elements come into contact, wherein the positioning elements further comprise a firmly mounted base part and an attachment which can be installed on and removed from the base part.

9. A mobile dividing wall comprising:

at least two wall elements that are angularly positionable with respect to each other and which have convex edge profiles which at least in sections are covered with hook and loop fabric material for the fastening together of said at least wall elements, said wall elements having positioning elements that are aligned with respect to each other during the positioning of said wall elements with respect to each other, said positioning elements being magnetically attracted to each other.

10. A mobile dividing wall comprising:

a first wall section having a convex edge profile with an upper end and a lower end, a second wall section having a convex edge profile with an upper end and a lower end, positioning elements provided on said upper ends and said lower ends of said convex edge profiles of said first and second wall sections, and fastening elements provided on portions of said convex profiles of said first and second wall sections between said positioning elements, said positioning elements further comprising a protrusion of a first positioning element on one wall section entering a recess of a second positioning element on the other wall section, wherein said positioning elements of said first and second wall sections are adapted to engage with each other to ensure the alignment of said first and second wall sections during assembly of said wall sections and to ensure the vertical alignment of said first and second wall sections after assembly of said wall sections, and wherein said positioning elements extend outwardly with respect to said fastening elements to engage with each other prior to engagement of said fastening elements to ensure alignment of said first and second wall sections prior to fastening of said wall sections.

11. A mobile dividing wall according to claim 10, wherein said fastening elements further comprise hook and loop materials.

12. A mobile dividing wall according to claim 11, wherein said positioning elements are adapted to engage when said wall sections are angularly positioned with respect to each other and wherein said wall sections are adapted to interlock.

* * * * *